US009274475B2

(12) United States Patent
Matsumoto et al.

(10) Patent No.: US 9,274,475 B2
(45) Date of Patent: Mar. 1, 2016

(54) IMAGE FORMING APPARATUS, IMAGE FORMING SYSTEM, AND IMAGE FORMING METHOD

(71) Applicant: Konica Minolta, Inc., Tokyo (JP)

(72) Inventors: Hiroshi Matsumoto, Tokyo (JP); Kazunori Nishinoue, Tokyo (JP); Taizou Oonishi, Tokyo (JP); Makoto Fujii, Tokyo (JP); Miho Yamano, Tokyo (JP); Atsushi Nakamura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/508,289

(22) Filed: Oct. 7, 2014

(65) Prior Publication Data

US 2015/0125173 A1 May 7, 2015

(30) Foreign Application Priority Data

Nov. 7, 2013 (JP) ..... 2013-230828

(51) Int. Cl.
*G03G 15/00* (2006.01)
*B65H 15/00* (2006.01)
(Continued)

(52) U.S. Cl.
CPC ..... *G03G 15/50* (2013.01); *B65H 15/00* (2013.01); *B65H 85/00* (2013.01); *G03G 15/234* (2013.01); *B65H 2301/3123* (2013.01); *B65H 2301/33214* (2013.01); *B65H 2301/33312* (2013.01);
(Continued)

(58) Field of Classification Search
CPC ..... G03G 15/50; G03G 15/234; G03G 2215/00438; G03G 15/6573; B65H 15/00
USPC ..... 399/82
See application file for complete search history.

(56) References Cited

U.S. PATENT DOCUMENTS

2009/0136279 A1* 5/2009 Kawabata ..... 399/401

FOREIGN PATENT DOCUMENTS

JP H10-181969 A 7/1998
JP 2002-249272 9/2002
(Continued)

OTHER PUBLICATIONS

Office Action dated Sep. 24, 2015 issued from the corresponding Japanese patent application No. 2013-230828.
(Continued)

*Primary Examiner* — David Bolduc
*Assistant Examiner* — Barnabas Fekete
(74) *Attorney, Agent, or Firm* — Lucas & Mercanti, LLP

(57) ABSTRACT an image forming apparatus including; a non-inversion conveyance unit that conveys a sheet to a downstream without inverting through the image forming unit; an inversion conveyance unit that inverts the sheet with printing on one side and that conveys the sheet to an upstream; a first sheet inversion unit that is arranged on the inversion conveyance unit and inverts the front and back of the sheet conveyed by the inversion conveyance unit; a control unit that controls the image forming unit and the conveyance unit, wherein the control unit includes a single-sided print mode and a double-sided print mode, and at a breakpoint of jobs, the control unit discharges the sheet so as to provide charge polarity that does not electrostatically attract a sheet discharged just before the breakpoint and a sheet discharged just after the breakpoint at least in the double-sided print mode.

15 Claims, 11 Drawing Sheets

(51) Int. Cl.
*G03G 15/23* (2006.01)
*B65H 85/00* (2006.01)

(52) U.S. Cl.
CPC . *B65H2301/5132* (2013.01); *B65H 2301/5133* (2013.01); *B65H 2511/415* (2013.01); *B65H 2515/716* (2013.01); *B65H 2601/273* (2013.01); *G03G 15/6573* (2013.01); *G03G 2215/00438* (2013.01); *G03G 2215/00654* (2013.01)

(56) References Cited

FOREIGN PATENT DOCUMENTS

| | | | |
|---|---|---|---|
| JP | 2004-010240 | A | 1/2004 |
| JP | 2007-168116 | A | 7/2007 |

OTHER PUBLICATIONS

English translation of Office Action dated Sep. 24, 2015 issued from the corresponding Japanese patent application No. 2013-230828.

* cited by examiner

1

IMAGE FORMING APPARATUS, IMAGE FORMING SYSTEM, AND IMAGE FORMING METHOD

CROSS-REFERENCE TO RELATED APPLICATIONS

The present application claims priority under 35 U.S.C. §119 to Japanese Patent Application No. 2013-230828, filed Nov. 7, 2013. The contents of this application are incorporated herein by reference in their entirety.

BACKGROUND OF THE INVENTION

1. Field of the Invention

This invention relates to an image forming apparatus that performs printing on a sheet based on image data, and particularly, to an image forming apparatus, an image forming system, and an image forming method including a single-sided print mode and a double-sided print mode.

2. Description of the Related Art

In an electro photographic type image forming apparatus, a latent image is formed on a photoreceptor based on image data, and the latent image is developed by a toner image. The developed toner image is transferred to a sheet through a transfer unit. In an apparatus that temporarily transfers the toner image to an intermediate transfer unit, the toner image of the intermediate transfer unit is transferred to a sheet through a transfer unit equivalent to a secondary transfer unit.

In these transfer units, a positive charge is provided to the back side of the sheet to attract a negatively charged toner image to the sheet to transfer the toner image in order to ensure the transfer. A fixing apparatus then fixes the toner image to the sheet and discharges the sheet with the fixed toner image to a discharge tray.

An example of such an image forming apparatus includes an apparatus including two modes, a discharge mode of discharging the sheet provided with the fixed toner image without changing the direction of the front and back of the sheet and a discharge mode of discharging the sheet by inverting the front and back of the sheet (for example, see Japanese Patent Laid-Open No. 2007-168116). In such an image forming apparatus, the discharge modes can be switched for each job to facilitate separation on a job-to-job basis.

In the image forming apparatus, the positive charge is provided from the back side of the sheet as described above in the process of transferring the toner image to the sheet. Consequently, the surface provided with the toner image is negatively charged, and the surface on the opposite side provided with the positive charge is positively charged in the sheet after the transfer of the toner image.

When the charged sheets are discharged to the discharge tray as described above, if, for example, the directions of the front and back of the previous and next sheets between jobs are the same as the previously charged sheet as shown in FIG. 11, the positively charged surface and the negatively charged surface of the sheets are placed on top of each other. There is a problem that the sheets stick to each other or that it is difficult to put the sheets in order. The problem becomes more apparent when post-processing is applied to the sheets. The problem becomes particularly prominent in a printed matter in a PP (Production Print) device field.

In the image forming apparatus described in Japanese Patent Laid-Open No. 2007-168116, two modes of a mode of discharging the sheet without changing the direction of the front and back of the sheet and a mode of discharging the sheet by inverting the front and back of the sheet, are switched in each job.

In view of the problem, an apparatus including a discharge blower that discharges a sheet after transfer of an image is proposed (see Japanese Patent Laid-Open No. 10-181969). An apparatus including a first discharger and a second discharger to ensure the discharge is also proposed (see Japanese Patent Laid-Open No. 2004-10240).

However, in these image forming apparatuses, there is a possibility of attracting and attaching a positively charged surface and a negatively charged surface of sheets when the positively charged surface and the negatively charged surface on the front and back of the sheets are different at a copy-based breakpoint during double-sided printing, single-sided printing, or the like.

The present invention has been made in view of the circumstances, and at least an object of the present invention is to provide an image forming apparatus, an image forming system, and an image forming method that can take into account the polarity of the front and back of a preceding sheet at a breakpoint of jobs to prevent sticking of charged sheets.

SUMMARY OF THE INVENTION

To achieve at least one of the abovementioned objects, an image forming apparatus reflecting one aspect of the present invention including: an image forming unit that prints an image on a sheet based on image data; a conveyance unit including: a non-inversion conveyance unit that conveys the sheet to a downstream in a discharge direction without inverting the front and back through the image forming unit; and an inversion conveyance unit that inverts the front and back of the sheet with printing on one side and that conveys the sheet to an upstream in a sheet conveyance direction of the image forming unit; a first sheet inversion unit that is arranged on the inversion conveyance unit and that inverts the front and back of the sheet conveyed by the inversion conveyance unit; and a control unit that controls the image forming unit and the conveyance unit, wherein the control unit includes a single-sided print mode that can print an image on the front of the sheet through conveyance by the non-inversion conveyance unit and a double-sided print mode that can print images on the front and back of the sheet through the conveyance by the non-inversion conveyance unit and inversion conveyance by the inversion conveyance unit, and at a breakpoint of jobs, the control unit discharges the sheet so as to provide charge polarity that does not electrostatically attract a sheet discharged just before the breakpoint and a sheet discharged just after the breakpoint at least in the double-sided print mode.

In the image forming apparatus according to the abovementioned aspect, it is preferable that, in the discharge of the sheet just after the breakpoint, the control unit sets the same charge polarity for an upper loading surface of the sheet just before the breakpoint and for a lower loading surface of the sheet just after the breakpoint.

In the image forming apparatus according to the abovementioned aspect, it is preferable that further comprises a second sheet inversion unit that is arranged on the conveyance unit from the image forming unit to the downstream in the discharge direction and that inverts the front and back of the sheet conveyed by the conveyance unit, wherein after printing of images on the front and back of the sheet by the image forming unit, the control unit can perform a non-inversion discharge operation for discharging the sheet without inverting the front and back of the sheet by the second sheet inversion unit and an inversion discharge operation for inverting the front and back of the sheet by the second sheet inversion unit to discharge the sheet, and the control unit selects one of the non-inversion discharge operation and the inversion discharge operation to discharge the sheet just after the breakpoint.

In the image forming apparatus according to the abovementioned aspect, it is preferable that further comprises a charge unit that charges the printed sheet, wherein the control unit discharges the sheet just before the breakpoint and the sheet just after the breakpoint based on selection of operation by the charge unit.

In the image forming apparatus according to the abovementioned aspect, it is preferable that further comprises a storage unit that stores information related to the discharge direction of the front and back of the sheet just before the breakpoint, wherein the control unit discharges the sheet according to the information stored in the storage unit.

In the image forming apparatus according to the abovementioned aspect, it is preferable that further comprises a potential measurement unit that measures charged potential of the upper loading surface when the printed sheet is discharged, wherein the control unit discharges the sheet according to a measurement result of the potential measurement unit.

In the image forming apparatus according to the abovementioned aspect, it is preferable that further comprises a sheet existence detection unit that detects existence of a sheet on a discharge tray, wherein the control unit takes into account the charge polarity to discharge the sheet if there is a sheet on the discharge tray according to the sheet existence detection unit and discharges the sheet without taking into account the charge polarity if there is no sheet on the discharge tray according to the sheet existence detection unit.

In the image forming apparatus according to the abovementioned aspect, it is preferable that the control unit discharges the sheet so as to provide charge polarity that does not electrostatically attract a previous sheet printed previously and a following sheet printed next.

To achieve at least one of the abovementioned objects, an image forming system reflecting one aspect of the present invention including: an image forming unit that prints an image on a sheet based on image data; a conveyance unit including: a non-inversion conveyance unit that conveys the sheet to a downstream in a discharge direction without inverting the front and back through the image forming unit; and an inversion conveyance unit that inverts the front and back of the sheet with printing on one side and that conveys the sheet to an upstream in a sheet conveyance direction of the image forming unit; a first sheet inversion unit that is arranged on the inversion conveyance unit and that inverts the front and back of the sheet conveyed by the inversion conveyance unit; and a control unit that controls the image forming unit and the conveyance unit, wherein the control unit includes a single-sided print mode that can print an image on the front of the sheet through conveyance by the non-inversion conveyance unit and a double-sided print mode that can print images on the front and back of the sheet through the conveyance by the non-inversion conveyance unit and inversion conveyance by the inversion conveyance unit, and at a breakpoint of jobs, the control unit discharges the sheet so as to provide charge polarity that does not electrostatically attract a sheet discharged just before the breakpoint and a sheet discharged just after the breakpoint at least in the double-sided print mode.

In the image forming system according to the above-mentioned aspect, it is preferable that, in the discharge of the sheet just after the breakpoint, the control unit sets the same charge polarity for an upper loading surface of the sheet just before the breakpoint and for a lower loading surface of the sheet just after the breakpoint.

In the image forming system according to the above-mentioned aspect, it is preferable that further comprises a second sheet inversion unit that is arranged on the conveyance unit from the image forming unit to the downstream in the discharge direction and that inverts the front and back of the sheet conveyed by the conveyance unit, wherein after printing of images on the front and back of the sheet by the image forming unit, the control unit can perform a non-inversion discharge operation for discharging the sheet without inverting the front and back of the sheet by the second sheet inversion unit and an inversion discharge operation for inverting the front and back of the sheet by the second sheet inversion unit to discharge the sheet, and the control unit selects one of the non-inversion discharge operation and the inversion discharge operation to discharge the sheet just after the breakpoint.

In the image forming system according to the above-mentioned aspect, it is preferable that further comprises a charge unit that charges the printed sheet, wherein the control unit discharges the sheet just before the breakpoint and the sheet just after the breakpoint based on operation by the charge unit.

In the image forming system according to the above-mentioned aspect, it is preferable that further comprises a storage unit that stores information related to the discharge direction of the front and back of the sheet just before the breakpoint, wherein the control unit discharges the sheet according to the information stored in the storage unit.

In the image forming system according to the above-mentioned aspect, it is preferable that further comprises a potential measurement unit that measures charged potential of the upper loading surface when the printed sheet is discharged, wherein the control unit discharges the sheet according to a measurement result of the potential measurement unit.

In the image forming system according to the above-mentioned aspect, it is preferable that further comprises a sheet existence detection unit that detects existence of a sheet on a discharge tray, wherein the control unit takes into account the charge polarity to discharge the sheet if there is a sheet on the discharge tray according to the sheet existence detection unit and discharges the sheet without taking into account the charge polarity if there is no sheet on the discharge tray according to the sheet existence detection unit.

In the image forming system according to the above-mentioned aspect, it is preferable that the control unit discharges the sheet so as to provide charge polarity that does not electrostatically attract a previous sheet printed previously and a following sheet printed next.

To achieve at least one of the abovementioned objects, an image forming method reflecting one aspect of the present invention, the image forming method of printing images on the front and back of a sheet based on image data, wherein the images are printed on the front and back of the sheet by non-inversion conveyance for conveying the sheet without inverting the front and back of the sheet and by inversion conveyance for conveying the sheet by inverting the front and back of the sheet, and then the sheet is discharged so as to provide charge polarity that does not electrostatically attract a sheet discharged just before a breakpoint of jobs and a sheet discharged just after the breakpoint.

DETAILED DESCRIPTION OF THE PREFERRED EMBODIMENTS

Hereinafter, an image forming apparatus as an embodiment of the present invention will be described with reference to the attached drawings.

Figure 1:
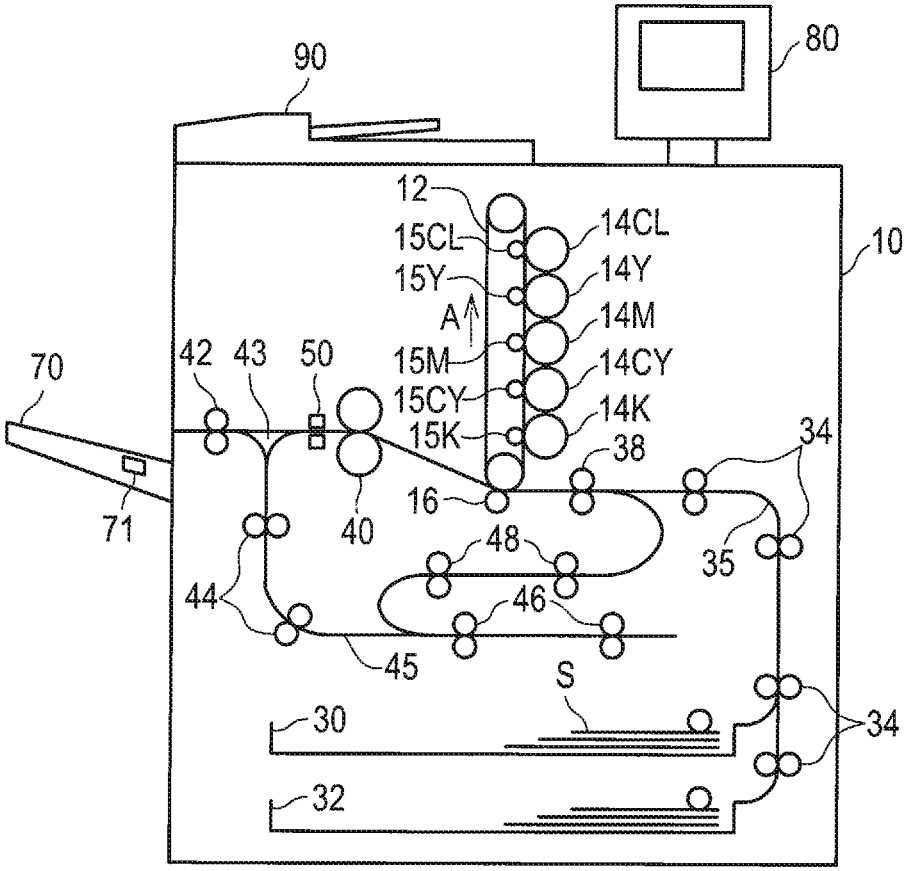
FIG. 1 is a diagram showing a configuration of an image forming apparatus of an embodiment of the present invention.

FIG. 1 shows a configuration of an image forming apparatus 1. The image forming apparatus 1 includes a printer 10, an operation panel 80, and an original reading unit 90. The printer 10 prints an image on a sheet based on image data. The operation panel 80 accepts an operation by a user, such as start of printing and selection of a print mode (such as a double-sided print mode and a high-gloss mode). The original reading unit 90 reads an original to generate image data.

An intermediate transfer belt 12 is disposed at a center of the printer 10. The intermediate transfer belt 12 is rotated and driven in an arrow A direction, and a toner image formed on the surface of a photosensitive drum is primarily transferred to the intermediate transfer belt 12. The primarily transferred toner image on the intermediate transfer belt 12 is secondarily transferred to a sheet S.

Five imaging units 14CL, 14Y, 14M, 14CY, and 14K (hereinafter, reference numerals are simplified and indicated by "14") are disposed on a side surface of the intermediate transfer belt 12 in the order of clear (CL), yellow (Y), magenta (M), cyan (C), and black (K) from the top. Each imaging unit 14 includes a photosensitive drum not shown. A charger that uniformly charges the surface of the photosensitive drum, exposure means for forming an electrostatic latent image on the surface of the uniformly charged photosensitive drum according to image data, and a developing device that develops the electrostatic latent image into a toner image are disposed around each photosensitive drum (they are not shown).

Primary transfer rollers 15CL, 15Y, 15M, 15CY, and 15K (hereinafter, reference numerals are simplified and indicated by "15") are disposed on positions facing the photosensitive drums across the intermediate transfer belt 12. The primary transfer rollers 15 electrostatically attract the toner images formed on the surfaces of the photosensitive drums to primarily transfer the toner images to the intermediate transfer belt 12.

Secondary transfer rollers 16 are disposed below the intermediate transfer belt 12. The secondary transfer rollers 16 secondarily transfer the toner images formed on the intermediate transfer belt 12 to the conveyed sheet S. For the secondary transfer, a high-pressure positive transfer voltage is applied to the secondary transfer rollers 16 to electrostatically attract the negatively charged toner images to the sheet S.

A fixing unit 40 that fixes the transferred toner images to the sheet S is disposed on the downstream of the secondary transfer rollers 16. Discharge rollers 42 that discharge the sheet S to a discharge tray 70 through a switching gate 43 are disposed on the further downstream of the fixing unit 40. The discharge rollers 42 and the discharge tray 70 form a discharge unit.

A potential measurement unit 50 that measures charged potential on the upper surface of the printed sheet is arranged on a conveyance path 35 between the fixing unit 40 and an inversion conveyance path 45 described later. The configuration of the potential measurement unit 50 is not particularly limited, and a well-known surface potential sensor or the like can be used.

A sheet existence detection unit 71 that detects existence of a sheet on the tray is arranged on the discharge tray 70. The configuration of the sheet existence detection unit 71 is not particularly limited, and an optical sensor or the like can be used.

Paper feeding cassettes 30 and 32 in a two-stage configuration are removably disposed below the printer 10. The conveyance path 35 is arranged, from the paper feeding cassettes 30 and 32 to the discharge tray 70 through intermediate conveyance rollers 34, registration rollers 38, the secondary transfer rollers 16, the fixing unit 40, and the discharge rollers 42. The rollers and the conveyance path 35 form a non-inversion conveyance unit. In this embodiment, the non-inversion conveyance unit is formed by a straight conveyance unit, and a conveyance unit from an image forming unit to the downstream in the discharge direction is formed by the non-inversion conveyance unit. The inversion conveyance path 45 that branches from the conveyance path 35 through the switching gate 43 on the downstream of the fixing unit 40 and that merges into the conveyance path 35 just before the registration rollers 38 positioned on the upstream in the sheet conveyance direction of the image forming unit is arranged above the paper feeding cassettes 30 and 32.

ADU inversion rollers 46 and ADU intermediate conveyance rollers 48 that invert the front and back of the sheet S to convey the sheet to the downstream of the inversion conveyance path 45 are arranged on the downstream of the inversion conveyance path 45.

Conveyance inversion rollers 44 that invert the front and the back of the sheet conveyed from the fixing unit 40 and that convey the sheet toward the discharge rollers 42 are disposed on the inversion conveyance path 45 positioned just below the conveyance path 35 from the fixing unit 40 to the discharge rollers 42, and part of the inversion conveyance path 45 merges into the conveyance path 35 on the downstream. The conveyance inversion rollers 44 and part of the inversion conveyance path 45 positioned near the conveyance inversion rollers 44 in the sheet conveyance direction form a sheet inversion unit of the present invention. Although the sheet inversion unit also serves as part of the inversion conveyance unit in this embodiment, they can be independently formed.

Figure 2:
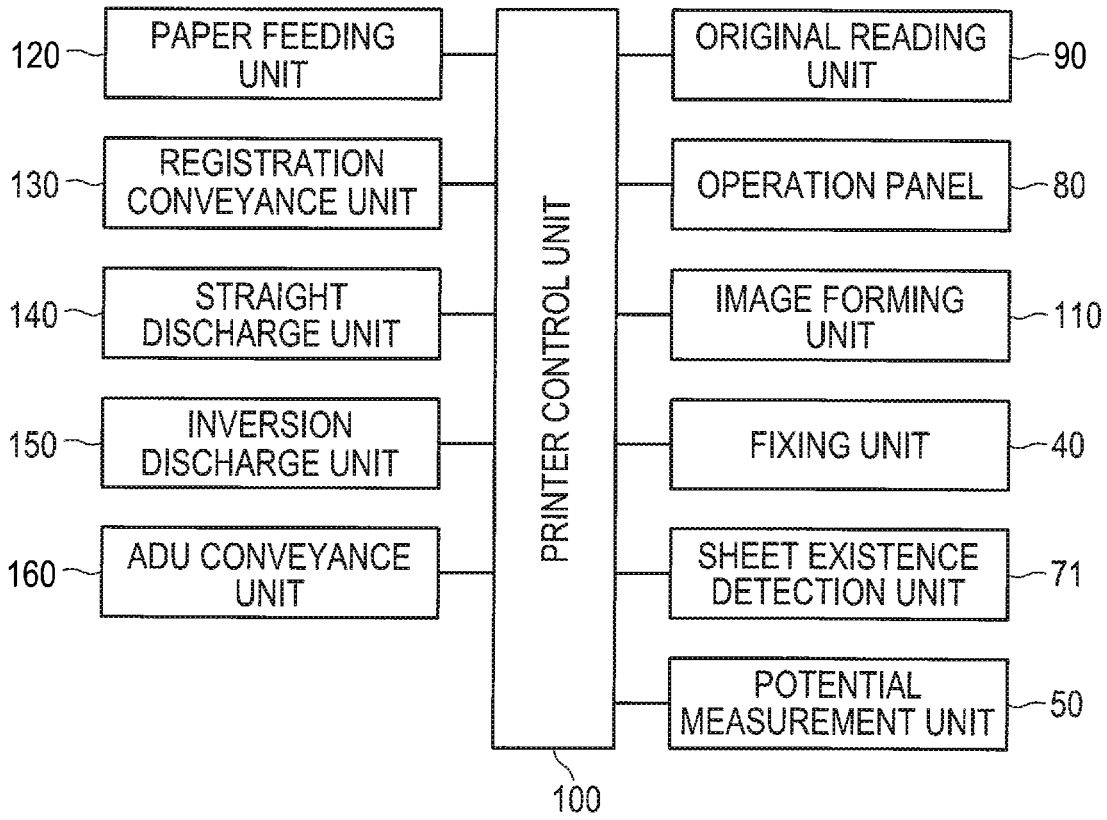
FIG. 2 is a control block diagram of the image forming apparatus.

Control blocks of the image forming apparatus 1 will be described with reference to FIG. 2.

A printer control unit 100 controls the entire image forming apparatus, such as formation of an image on the sheet S as well as conveyance, discharge of the sheet S and the like, and includes a CPU, a program for operating the CPU, a ROM, a RAM, a non-volatile memory, and the like. The printer control unit 100 is equivalent to a control unit of the present invention. A flag indicating whether the discharge direction (front and back) of the discharged sheet just before the breakpoint is straight or inverted can be stored as a P value in the RAM or the non-volatile memory not shown. P=0 indicates a straight flag, and P=1 indicates an inversion flag. The flags are equivalent to information related to the discharge direction. The RAM or the non-volatile memory is equivalent to a storage unit of the present invention when the information related to the discharge direction of the front and back of the sheet just before the breakpoint is stored in the RAM or the non-volatile memory.

The original reading unit 90 is connected to the printer control unit 100, and the original reading unit 90 can be controlled by the printer control unit 100. The original reading unit 90 reads an image of an original set in the unit to generate image data.

The operation panel 80 is connected to the printer control unit 100, and the operation panel 80 can be controlled by the printer control unit 100. The operation panel 80 accepts an operation from the user in relation to start of printing, a print mode (double-sided print mode, high-gloss mode, or the like), setting of a breakpoint of jobs, and the like. Details of the operation are transmitted to the printer control unit 100.

An image forming unit 110 is connected to the printer control unit 100, and the image forming unit 110 can be controlled. The image forming unit 110 forms a toner image on a photosensitive drum based on the image data and primarily transfers the formed toner image to the intermediate transfer belt 12. The image forming unit 110 then secondarily transfers the toner image on the intermediate transfer belt 12 to the sheet S conveyed to the secondary transfer rollers 16.

The fixing unit 40 is connected to the printer control unit 100, and the fixing unit 40 can be controlled by the printer control unit 100. The fixing unit 40 fixes the toner image transferred to the sheet S by thermal dissolution.

A paper feeding unit 120 is connected to the printer control unit 100, and the paper feeding unit 120 can be controlled by the printer control unit 100. The paper feeding unit 120 is a control unit for conveying the sheets S loaded and housed in the paper feeding cassettes 30 and 32 to the registration rollers 38 by the intermediate conveyance rollers 34.

A registration conveyance unit 130 is connected to the printer control unit 100, and the registration conveyance unit 130 can be controlled by the printer control unit 100. The registration conveyance unit 130 is a control unit for conveying the sheet S from the registration rollers 38 to the fixing unit 40.

A straight discharge unit 140 is connected to the printer control unit 100, and the straight discharge unit 140 can be controlled by the printer control unit 100. The straight discharge unit 140 is a control unit that discharges the sheet S passed through the fixing unit 40 to the discharge tray 70 by the discharge rollers 42 without inverting the front and back.

An inversion discharge unit 150 is connected to the printer control unit 100, and the inversion discharge unit 150 can be controlled by the printer control unit 100. The inversion discharge unit 150 is a control unit for inverting, by the conveyance inversion rollers 44, the front and back of the sheet S passed through the fixing unit 40 and discharging the sheet S to the discharge tray 70.

An ADU conveyance unit 160 is connected to the printer control unit 100, and the ADU conveyance unit 160 can be controlled by the printer control unit 100. The ADU conveyance unit 160 is a control unit for inverting, by the conveyance inversion rollers 44 and the ADU inversion rollers 46, the sheet S passed through the fixing unit 40 and conveying the sheet S to the registration rollers 38 by the ADU intermediate conveyance rollers 48.

The potential measurement unit 50 is connected to the printer control unit 100, and the potential measurement unit 50 can be controlled by the printer control unit 100. The potential measurement unit 50 measures the potential of the front side of the sheet that is the front loading surface of the printed sheet on the discharge tray 70 and transmits the measurement result to the printer control unit 100.

The sheet existence detection unit 71 is connected to the printer control unit 100, and the sheet existence detection unit 71 can be controlled by the printer control unit 100. The sheet existence detection unit 71 detects whether there is a discharged sheet on the discharge tray 70 in response to an instruction from the printer control unit 100 and transmits the detection result to the printer control unit 100.

Hereinafter, basic operation of the image forming apparatus 1 will be described.

When the user performs operation for starting printing from the operation panel 80, the original reading unit 90 reads the set original to generate image data. The exposure means forms an electrostatic latent image on the surface of the uniformly charged photosensitive drum based on the generated image data. The developing device develops the formed electrostatic latent image into a toner image. The primary transfer rollers 15 electrostatically attract the toner image formed on the surface of the photosensitive drum to primarily transfer the toner image to the intermediate transfer belt 12. The method of acquiring the image data is not limited to the method described above, and the image data can be acquired through a network.

According to the operation for starting printing, the sheets S loaded and housed in the paper feeding cassettes 30 and 32 are sent out to the conveyance path 35 one by one based on the control by the paper feeding unit 120, and the intermediate conveyance rollers 34 convey the sheets S to the registration rollers 38 through the conveyance path 35. The sheets S conveyed to the registration rollers 38 are conveyed to a position of contact with the secondary transfer rollers 16 in synchronization with the toner images on the intermediate transfer belt 12.

The toner image on the intermediate transfer belt 12 is secondarily transferred to the sheet S at the position of the secondary transfer rollers 16. In the secondary transfer, a high-pressure positive transfer voltage is applied to the secondary transfer rollers 16 to electrostatically attract and transfer the negatively charged toner image from the intermediate transfer belt 12 to the sheet S. The toner image transferred to the sheet S is transmitted through the conveyance path 35, and the fixing unit 40 fixes the toner image to the sheet S by thermal dissolution. In the single-sided print mode, the sheet S is discharged to the discharge tray 70 through the discharge rollers 42.

There are two types of modes of discharge to the discharge tray 70, straight discharge and inversion discharge. The straight discharge is a discharge mode of discharging the sheet S to the discharge tray 70 without inverting the front and back of the sheet S after printing the image on the sheet S. In the straight discharge mode, the sheet S is discharged face up. The inversion discharge is a discharge mode of discharging the sheet S to the discharge tray 70 by inverting the front and back of the sheet S after printing the image on the sheet S. In the inversion discharge mode, the sheet S is discharged face down.

Figure 3:
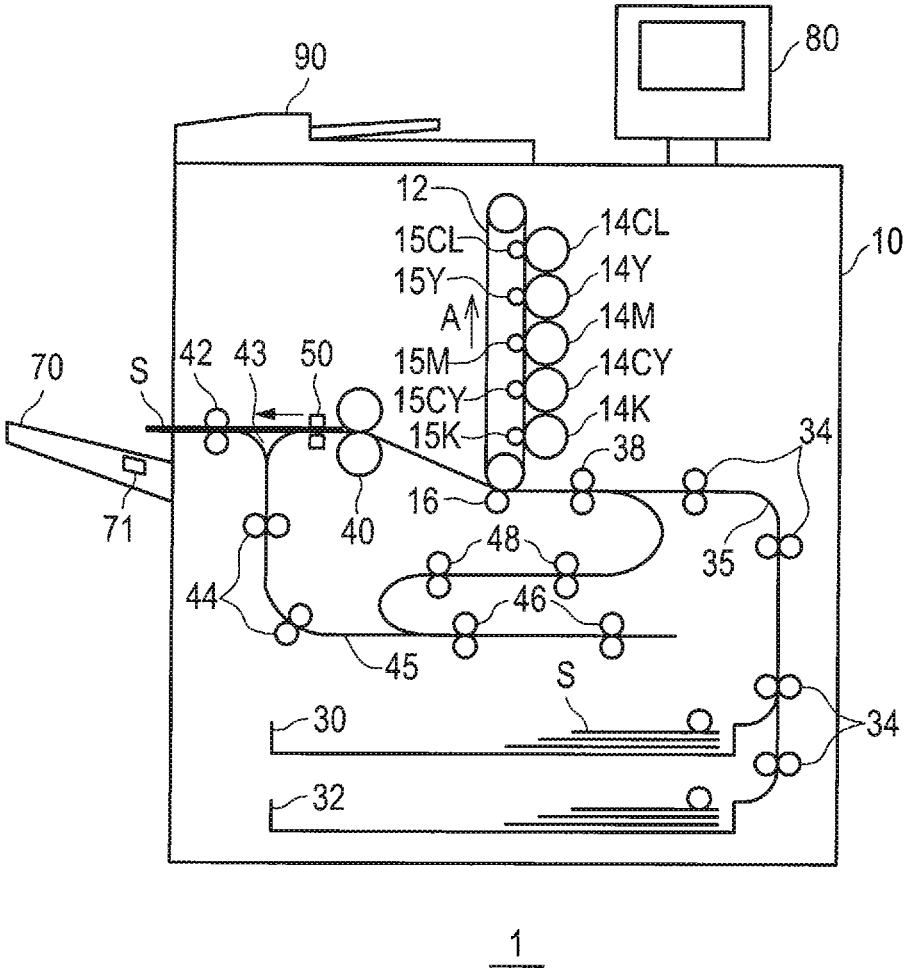
FIG. 3 is a diagram showing operation during straight discharge in the image forming apparatus.

FIG. 3 shows sheet conveyance operation of the straight discharge. In the straight discharge, the front and back of the sheet S passed through the fixing unit 40 is not inverted, and the sheet S is conveyed to the discharge rollers 42 and discharged to the discharge tray 70 through the discharge rollers 42 based on the control by the straight discharge unit 140.

Figure 4:
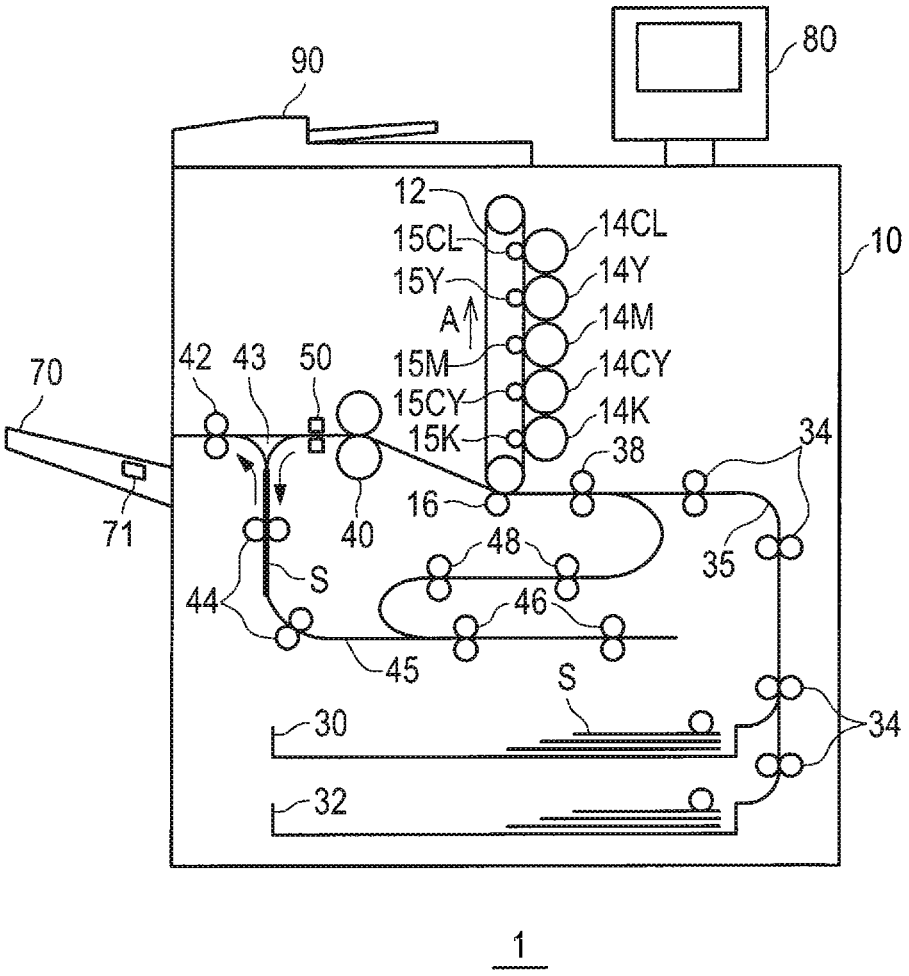
FIG. 4 is a diagram showing operation during inversion discharge in the image forming apparatus.

FIG. 4 shows sheet conveyance operation of the inversion discharge. In the inversion discharge, the sheet S passed through the fixing unit 40 is conveyed toward the conveyance inversion rollers 44 through switching operation of the switching gate 43 based on the control by the inversion discharge unit 150. In this case, the conveyance inversion rollers 44 are normally rotated and driven to convey the sheet S downward through the inversion conveyance path 45. The conveyance inversion rollers 44 are then reversely rotated and driven to convey the sheet S from the inversion conveyance path 45 toward the discharge rollers 42. As a result, the front and back of the sheet S are inverted. The sheet S in which the front and back are inverted is discharged to the discharge tray 70 through the discharge rollers 42.

Figure 5:
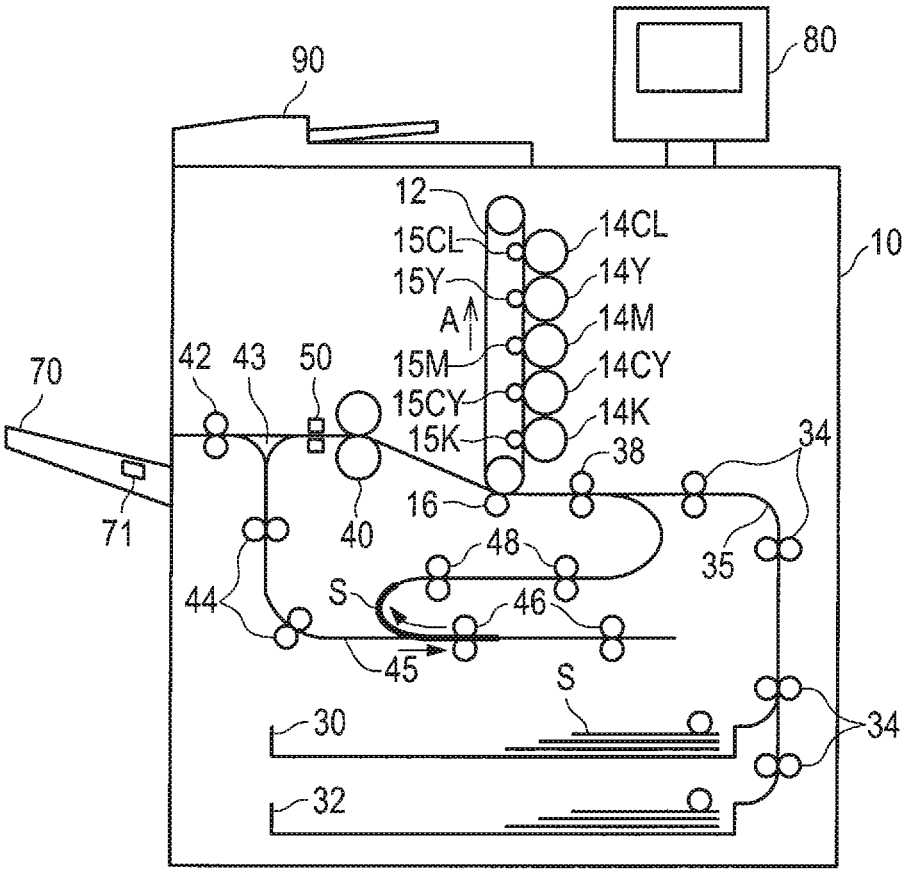
FIG. 5 is a diagram showing sheet conveyance operation during double-sided printing in the image forming apparatus.

The image forming apparatus of the present embodiment includes a double-sided print mode that can print images on both sides of the front and back of the sheet. FIG. 5 shows operation in the double-sided print mode.

The sheets S loaded and housed in the paper feeding cassettes 30 and 32 pass through the conveyance path 35 and are straightly conveyed to the secondary transfer rollers 16 through the intermediate conveyance rollers 34 and the registration rollers 38 based on the control by the registration conveyance unit 130. The secondary transfer rollers 16 transfer the toner image to one side of the sheet S, and the fixing unit 40 fixes the toner image to the sheet S.

The sheet S passed through the fixing unit 40 is conveyed toward the conveyance inversion rollers 44 based on the switch of the switching gate 43, and the normally rotated and driven conveyance inversion rollers 44 convey the sheet S to the normally rotated and driven ADU inversion rollers 46 through the inversion conveyance path 45. The sheet S conveyed to the ADU inversion rollers 46 temporarily pauses at this position. The ADU inversion rollers 46 are reversely rotated and driven to convey the sheet S to the ADU intermediate conveyance rollers 48, and the ADU intermediate conveyance rollers 48 convey the sheet S to the registration rollers 38. In this case, the front and back of the sheet S are inverted, and the sheet S is inversely conveyed to the registration rollers 38.

The sheet S conveyed to the registration rollers 38 is conveyed to the secondary transfer rollers 16 through the conveyance path 35. The toner image is transferred to the other side of the sheet S, and the fixing unit 40 fixes the toner image. The sheet S is then discharged to the discharge tray 70 through the discharge rollers 42.

In any embodiment, the potential measurement unit 50 can measure the potential of the upper surface of the sheet passing through the fixing unit 40, and the sheet existence detection unit 71 detects the presence of the sheet discharged to the discharge tray 70.

The charge state in the transfer of image and the discharge of the sheet S will be described. As described, the toner is negatively charged in the transfer of image to the sheet S, and a positive charge is provided from the back side of the sheet near the secondary transfer rollers 16 to attract the toner to the sheet in order to surely transfer the toner to the sheet S. As a result, the upper side is negatively charged, and the lower side is positively charged in the sheet S after the image transfer. If the sheets are discharged and piled up without taking any countermeasure, the front and back sides (side 1, side 2) of the previous and next sheets are in positively and negatively charged states. Attractive force is generated with respect to each other, and the sheets stick to each other.

Figure 6:
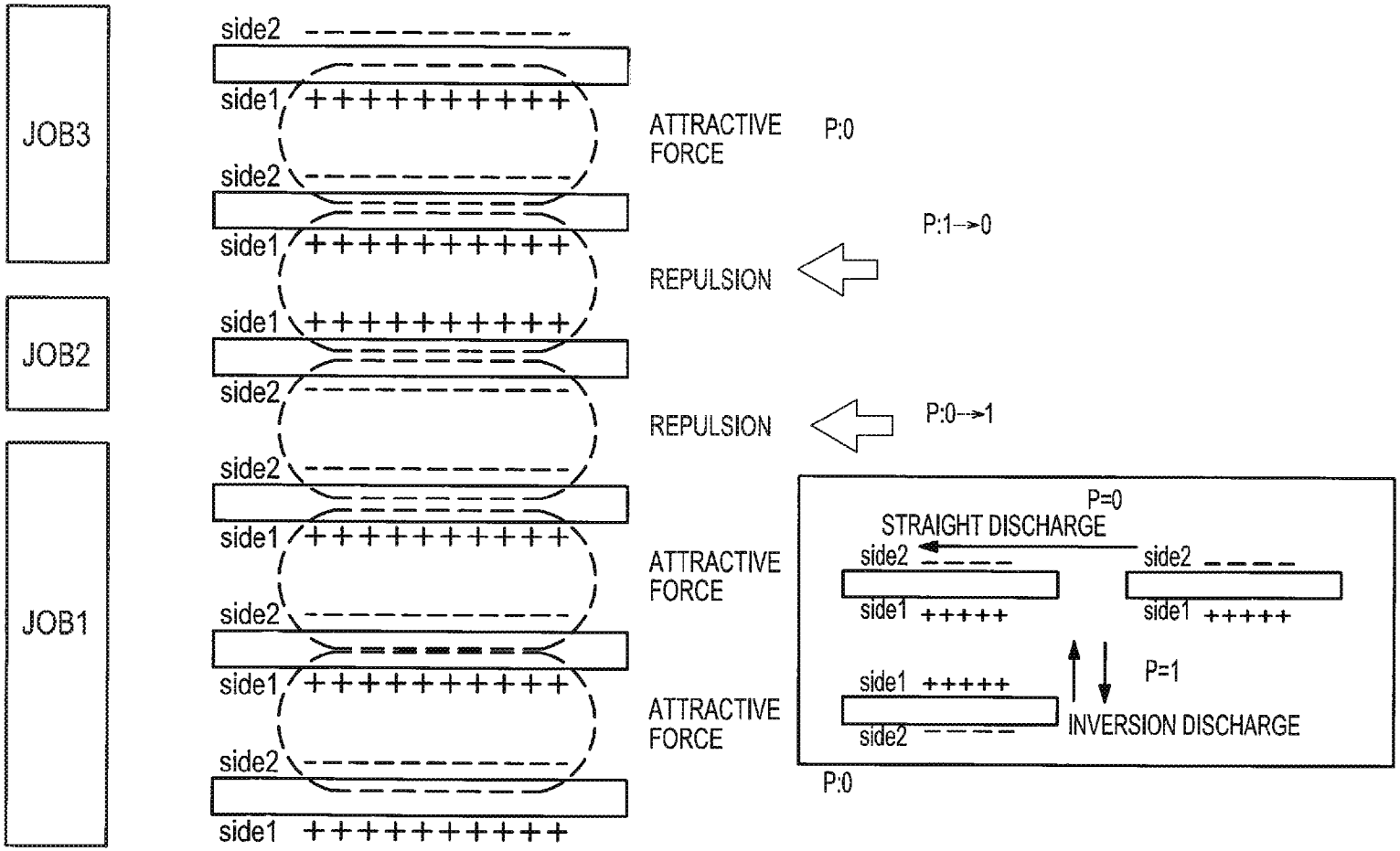
FIG. 6 is a diagram showing polarity charged on the front and back of a sheet at an arbitrary breakpoint in the image forming apparatus.

In the present embodiment, the polarity of the front and back of the previous sheet is taken into account at a breakpoint of jobs as shown in FIG. 6, and one of the straight discharge and the inversion discharge is selected and performed. The sides 1 of the sheets or the sides 2 of the sheets face each other, and repulsion acts between the sheets. This can prevent attachment of the sheets.

Figure 7:
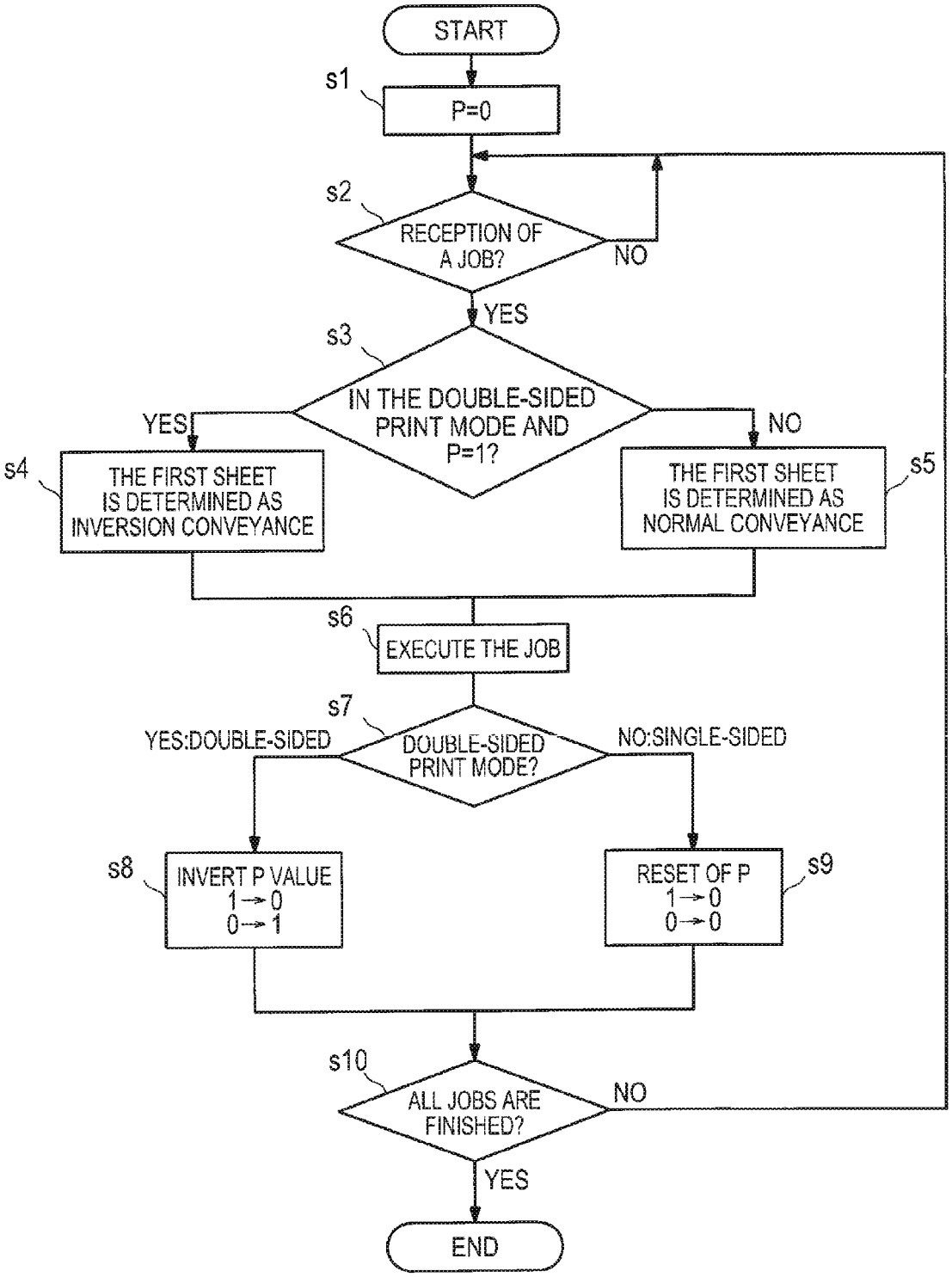
FIG. 7 is a flow chart showing a procedure of determining a discharge method in the image forming apparatus.

Hereinafter, a procedure of selecting and performing the straight discharge and the inversion discharge based on the P value and the print mode of the job at the breakpoint between jobs in the present embodiment will be described with reference to a flow chart of FIG. 7. The printer control unit 100 executes the following procedure.

In the RAM or the non-volatile memory of the printer control unit 100, it is assumed that the straight discharge is performed for the sheet just before the breakpoint, and P=0 is set (step s1). The printer control unit 100 waits for reception of a job (step s2). If a job is received (step s2, YES), the printer control unit 100 determines whether the received job is in the double-sided print mode and the discharged sheet just before the breakpoint indicates P=1 (step s3).

If the received job is in the double-sided print mode and the last discharged sheet of the previous job indicates P=1 (step s3, YES), the printer control unit 100 determines to perform the inversion discharge for the first sheet of the job that is a sheet just after the breakpoint (step s4) and executes the job (step s6).

If the received job is not in the double-sided print mode or if the last discharged sheet in the previous job does not indicate P=1 (step s3, NO), the printer control unit 100 determines to perform the straight discharge for the first sheet of the job that is a sheet just after the breakpoint (step s5) and executes the job by the set discharge method (step s6).

The printer control unit 100 determines whether the job is in the double-sided print mode (step s7). If the job is in the double-sided print mode (step s7, YES), the printer control unit 100 inverts the P value to 0 if the P value is 1 and inverts the P value to 1 if the P value is 0 (step s8). If the job is not in the double-sided print mode (step s7, NO), the printer control unit 100 resets the P value to 0 (step s9). After setting the P value, the printer control unit 100 determines whether all jobs are finished (step s10). The printer control unit 100 ends the process if all jobs are finished (step s10, YES) and returns to step s2 to continue the process if not all jobs are finished (step s10, NO).

In the embodiment described above, the inversion discharge and the straight discharge are selected for the sheet just after the breakpoint between jobs based on the P value that is information related to the discharge direction of the sheet, and sticking of the sheets between jobs can be prevented.

Figure 8:
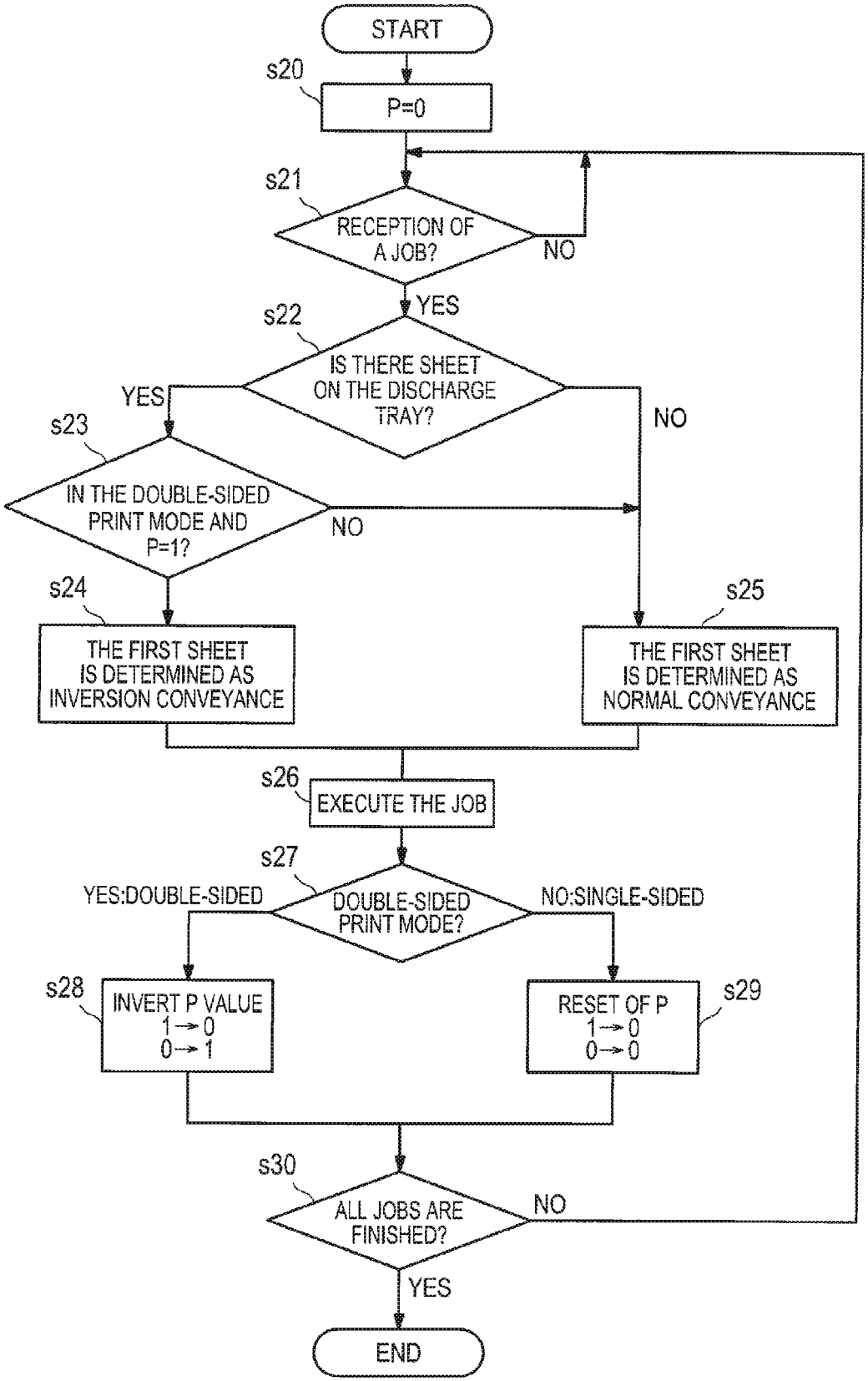
FIG. 8 is a flow chart showing another example of the procedure of determining the discharge method in the image forming apparatus.

Another embodiment will be described with reference to a flow chart of FIG. 8. In this embodiment, the straight discharge and the inversion discharge are selected to discharge the sheet based on whether there is a sheet on the discharge tray according to the detection result of the sheet existence detection unit 71. The printer control unit 100 executes the following procedure.

In the RAM or the non-volatile memory of the printer control unit 100, it is assumed that the straight discharge is performed for the sheet just before the breakpoint, and P=0 is set (step s20). The printer control unit 100 waits for reception of a job (step s21). If a job is received (step s21, YES), the printer control unit 100 determines whether there is a sheet on the discharge tray (step s22). Whether there is a sheet on the discharge tray is determined by the detection result of the sheet existence detection unit 71.

If there is a sheet on the discharge tray (step s22, YES), the printer control unit 100 determines whether the received job is in the double-sided print mode and the discharged sheet just before the breakpoint indicates P=1 (step s23). If there is no sheet on the discharge tray (step s22, No), the printer control unit 100 determines to perform the straight discharge for the first sheet of the job that is a sheet just after the breakpoint (step s25) and executes the job by the set discharge method (step s26).

If the received job is in the double-sided print mode and the last discharged sheet in the previous job indicates P=1 (step s23, YES), the printer control unit 100 determines to perform the inversion discharge for the first sheet of the job that is a sheet just after the breakpoint (step s24) and executes the job (step s26).

If the received job is not in the double-sided print mode or if the last discharged sheet in the previous job does not indicate P=1 (step s23, NO), the printer control unit 100 determines to perform the straight discharge for the first sheet of the job that is a sheet just after the breakpoint (step s25) and executes the job by the set discharge method (step s26).

After the execution of the job in step s26, the printer control unit 100 determines whether the job is in the double-sided print mode (step s27). If the job is in the double-sided print mode (step s27, YES), the printer control unit 100 inverts the P value to 0 if the P value is 1 and inverts the P value to 1 if the P value is 0 (step s28). If the job is not in the double-sided print mode (step s27, NO), the printer control unit 100 resets the P value to 0 (step s29). After setting the P value, the printer control unit 100 determines whether all jobs are finished (step s30). The printer control unit 100 ends the process if all jobs are finished (step s30, YES) and returns to step s21 to continue the process if not all jobs are finished (step s30, NO).

In the embodiment, the sheet existence detection unit 71 detects whether there is a sheet of the previous job on the discharge tray at the breakpoint between jobs, and normal conveyance is performed without the sheet. If there is a sheet on the discharge tray, whether to perform the straight discharge or to perform the inversion discharge for the sheet just after the breakpoint is selected, and the discharge is performed.

Figure 9:
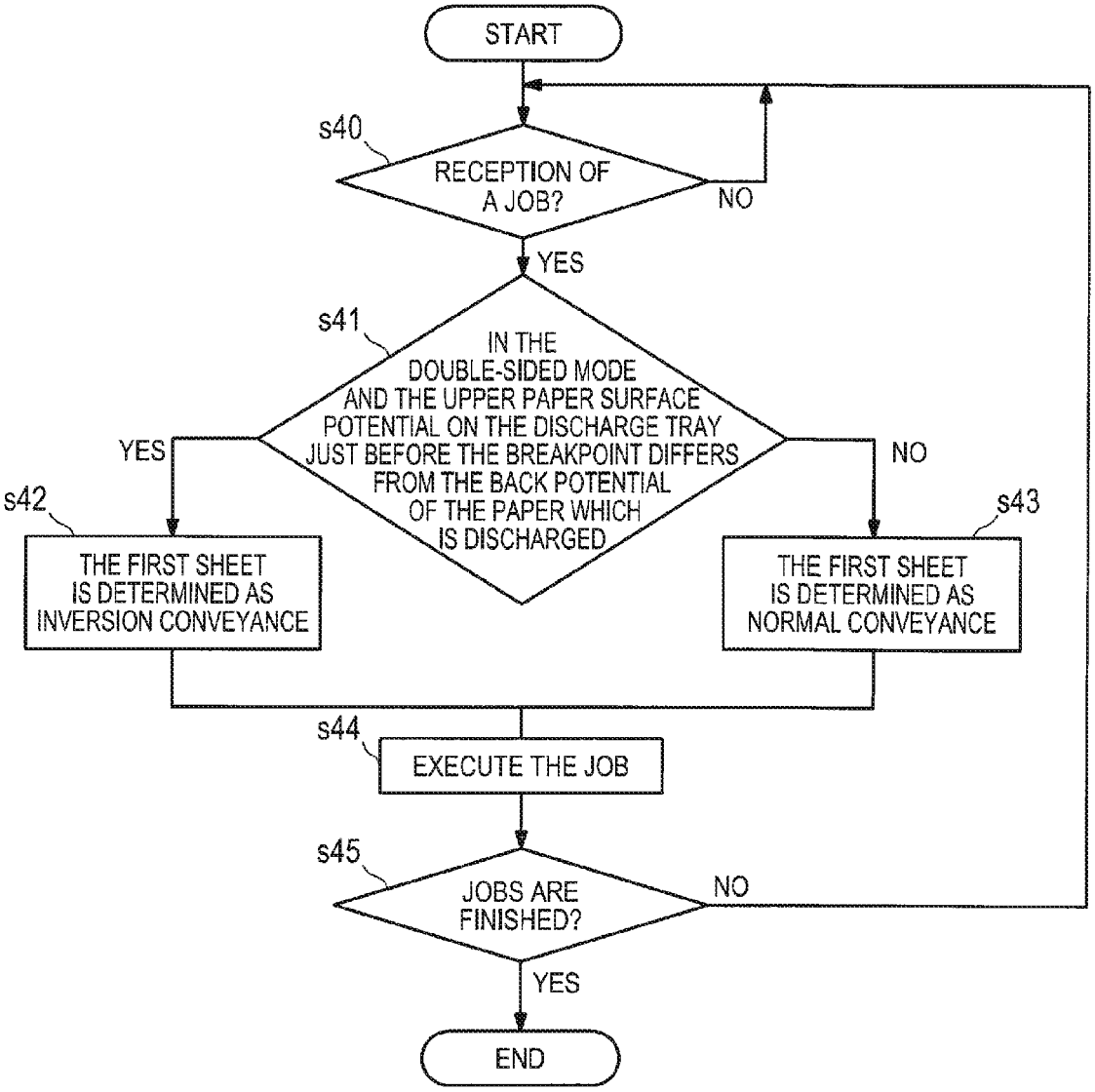
FIG. 9 is a flow chart showing another example of the procedure of determining the discharge method in the image forming apparatus.

Another embodiment will be described with reference to a flow chart of FIG. 9. In the present embodiment, the straight discharge and the inversion discharge are selected and performed based on the charge polarity of the upper loading surface of the sheet just before the breakpoint and the charging polarity of the job just after the breakpoint at the breakpoint between jobs. The printer control unit 100 executes the following procedure.

The procedure is executed when the sheet existence detection unit 71 detects the presence of a sheet on the discharge tray. The procedure can be immediately executed regardless of the detection result of the sheet existence detection unit 71, or the procedure can be immediately executed when the sheet existence detection unit 71 is not included.

When the process is started, the printer control unit 100 waits for reception of a job (step s40). If a job is received (step s40, YES), the printer control unit 100 determines whether the received job is in the double-sided print mode and whether the charge polarity of the upper loading surface on the discharge tray of the sheet just before the breakpoint and the charge polarity of the lower surface of the sheet to be discharged just after the breakpoint are different (step s41). The potential measurement unit 50 measures the charge polarity of the sheet. The charge polarity of the lower side measured by the potential measurement unit 50 is the charge polarity of the upper loading surface if the sheet is inversely discharged and is on the discharge tray. The charge polarity of the upper side of the sheet measured by the potential measurement unit 50 is the charge polarity of the upper loading surface if the sheet is normally conveyed. The charge polarity of the lower surface of the sheet to be discharged is the polarity measured by the potential measurement unit 50.

If the received job is in the double-sided print mode and if the charge polarity of the upper loading surface of the sheet just before the breakpoint and the charge polarity of the lower surface of the sheet just after the breakpoint are different (step s41, YES), the printer control unit 100 determines to perform the inversion discharge for the first sheet of the job (step s42) and executes the job (step s44).

If the received job is not in the double-sided print mode or if the charge polarity of the upper loading surface of the sheet just before the breakpoint and the charge polarity of the lower surface of the sheet just after the breakpoint are the same (step s41, NO), the printer control unit 100 determines to normally convey the first sheet of the job (step s43) and executes the job (step s44).

After the execution of the job (step s44), the printer control unit 100 determines whether all jobs are finished (step s45).

If all jobs are finished (step s45, YES), the printer control unit 100 ends the process. If not all jobs are finished (step s45, NO), the printer control unit 100 returns to step s40 to continue the process.

In the embodiments, the straight discharge and the inversion discharge are selected and performed at the breakpoint between jobs based on the charge polarity of the upper loading surface of the sheet just before the breakpoint and the charge polarity of the lower surface of the sheet just after the breakpoint. More specifically, if the charge polarity of the upper loading surface of the sheet and the charge polarity of the lower surface of the sheet are different in the double-sided print mode, one of the inversion discharge and the straight discharge is selected as the discharge mode of the sheet just after the breakpoint so that the charge polarity of the upper loading surface and the charge polarity of the lower loading surface become the same.

Although the charge polarity that does not electrostatically attract the sheet just before the breakpoint and the sheet just after the breakpoint is provided based on the selection of the inversion discharge and the straight discharge in the embodiments, the printed sheet can be charged to invert the charge polarity to thereby provide the charge polarity that does not electrostatically attract the sheet just before the breakpoint and the sheet just after the breakpoint.

Figure 10:
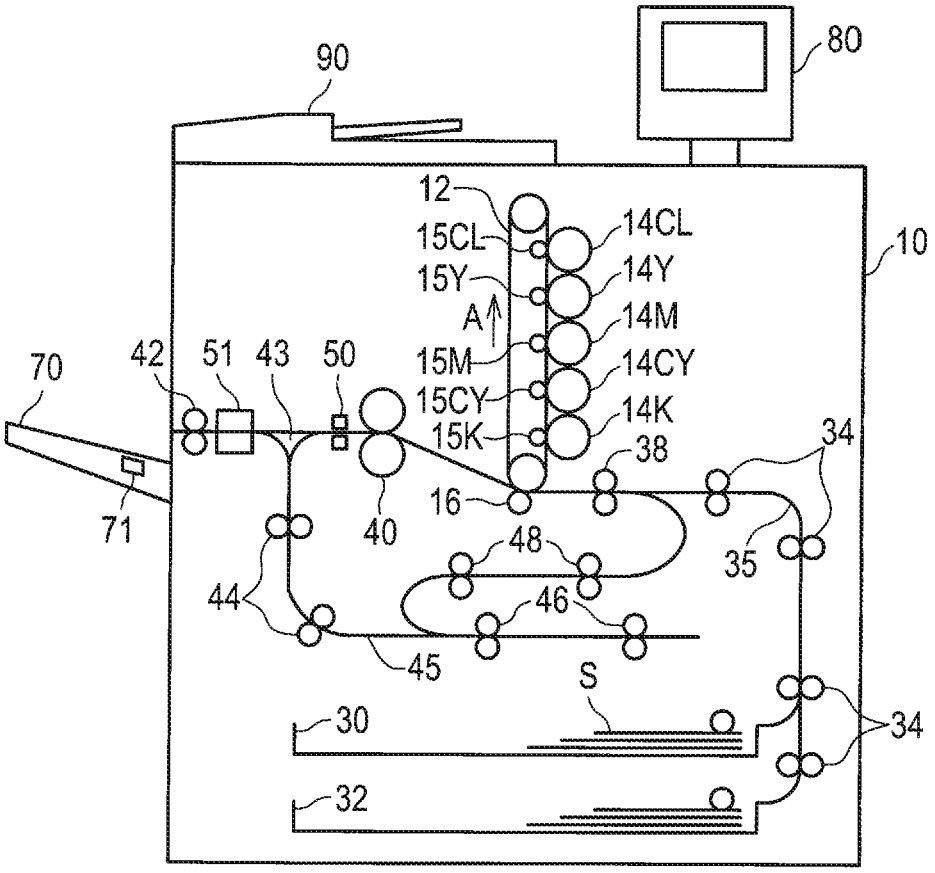
FIG. 10 is a diagram showing a device configuration of another embodiment of the image forming apparatus.
Figure 11:
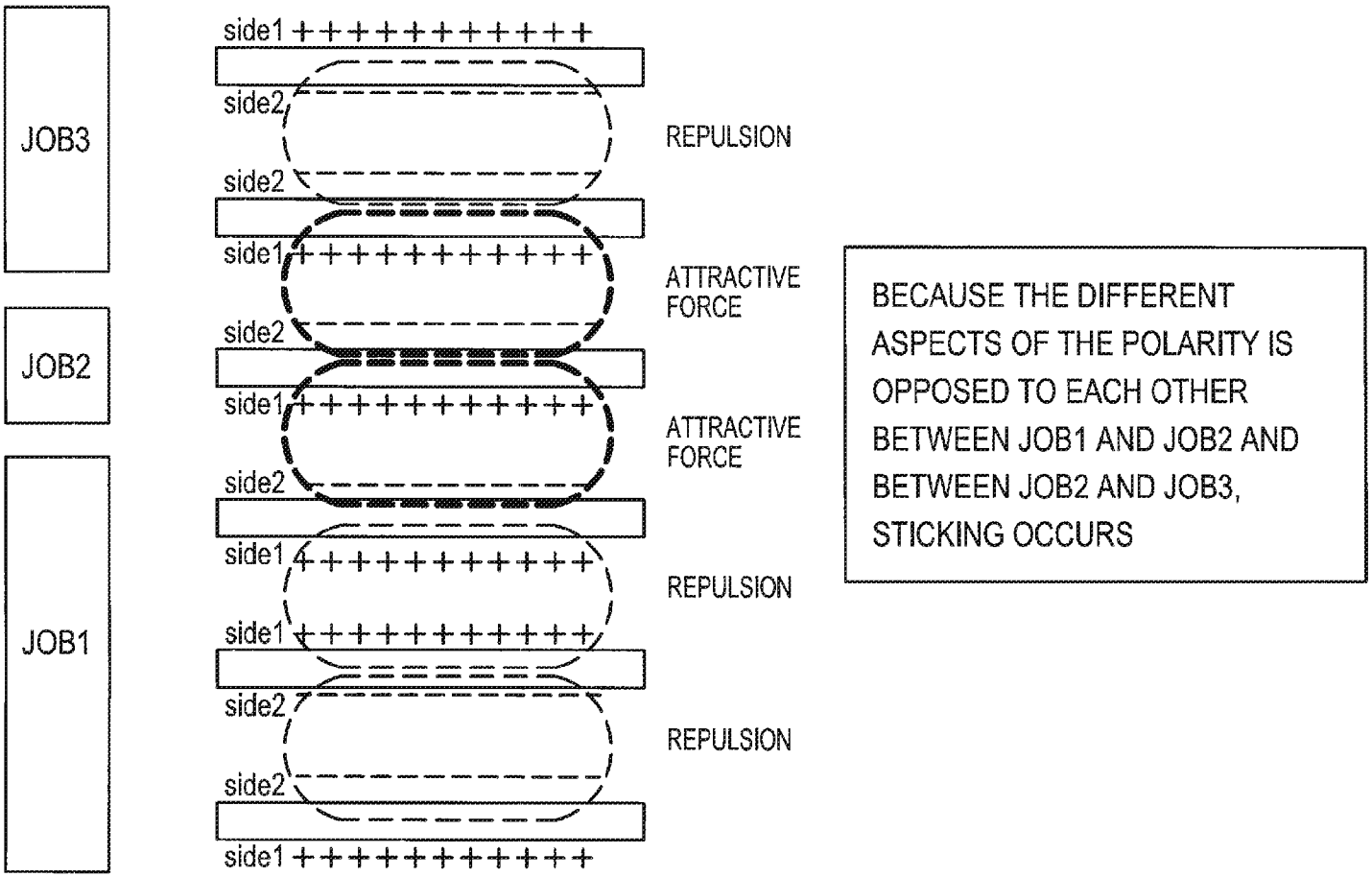
FIG. 11 is a diagram showing a state in which charge polarity of the front and back of the sheet is reversed polarity at a breakpoint between jobs in a conventional image forming apparatus.

FIG. 10 includes a charge unit 51 between the meeting point with the inversion conveyance path 45 and the discharge rollers 42 (just before the discharge rollers 42 on the upstream) on the conveyance path 35, and the printed sheet can be charged at a desired polarity as necessary to invert the charge polarity of the front and back of the sheet charged before the charge unit 51 charging.

As a result of the charge, the upper loading surface of the sheet just before the breakpoint of the job and the lower loading surface of the sheet just after the breakpoint of the job have the same polarity. Repulsion is generated with respect to each other, and sticking can be prevented.

Although the breakpoint between jobs is described as a breakpoint of jobs in the embodiments, the breakpoint can be a breakpoint between copies of a job, or the breakpoint can be an arbitrary breakpoint set by the user. The arbitrary breakpoint can be set based on, for example, switch in the type of sheet, switch in the presence or absence of tab paper or the like. The arbitrary breakpoint can be set through the operation panel 80, or the user can select which breakpoint is to be chosen through the operation panel.

Although the straight discharge and the inversion discharge are selected at the breakpoint of jobs in the description of the embodiments, the sheets can be discharged so that the sheets to be printed within the breakpoint have charge polarity that does not cause the sheets to stick to each other. In this case, multiple sheets can be fed and conveyed. The straight discharge and the inversion discharge are selected before the multi feed, or the charge unit inverts the charged polarity as necessary.

As described, according to the embodiments, sticking and attaching of sheets due to charge polarity can be prevented at a breakpoint of jobs.

Although the present invention has been described based on the embodiments, the present invention is not limited to the content of the embodiments, and appropriate changes can be obviously made without departing from the present invention.

What is claimed is:

1. An image forming apparatus comprising:

an image forming unit that prints an image on a sheet based on image data;

a conveyance unit comprising: a non-inversion conveyance unit that conveys the sheet to a downstream in a discharge direction without inverting the front and back through the image forming unit; and an inversion conveyance unit that inverts the front and back of the sheet with printing on one side and that conveys the sheet to an upstream in a sheet conveyance direction of the image forming unit;

a first sheet inversion unit that is arranged on the inversion conveyance unit and that inverts the front and back of the sheet conveyed by the inversion conveyance unit;

a control unit that controls the image forming unit and the conveyance unit, wherein the control unit includes a single-sided print mode that can print an image on the front of the sheet through conveyance by the non-inversion conveyance unit and a double-sided print mode that can print images on the front and back of the sheet through the conveyance by the non-inversion conveyance unit and inversion conveyance by the inversion conveyance unit, and at a breakpoint of jobs, the control unit discharges the sheet so as to provide charge polarity that does not electrostatically attract a sheet discharged just before the breakpoint and a sheet discharged just after the breakpoint at least in the double-sided print mode; and a charge unit that charges the printed sheet, wherein the control unit discharges the sheet just before the breakpoint and the sheet just after the breakpoint based on selection of operation by the charge unit.

2. The image forming apparatus according to claim 1, wherein in the discharge of the sheet just after the breakpoint, the control unit sets the same charge polarity for an upper loading surface of the sheet just before the breakpoint and for a lower loading surface of the sheet just after the breakpoint.

3. The image forming apparatus according to claim 1, further comprising a second sheet inversion unit that is arranged on the conveyance unit from the image forming unit to the downstream in the discharge direction and that inverts the front and back of the sheet conveyed by the conveyance unit, wherein after printing of images on the front and back of the sheet by the image forming unit, the control unit can perform a non-inversion discharge operation for discharging the sheet without inverting the front and back of the sheet by the second sheet inversion unit and an inversion discharge operation for inverting the front and back of the sheet by the second sheet inversion unit to discharge the sheet, and the control unit selects one of the non-inversion discharge operation and the inversion discharge operation to discharge the sheet just after the breakpoint.

4. The image forming apparatus according to claim 1, further comprising a storage unit that stores information related to the discharge direction of the front and back of the sheet just before the breakpoint, wherein the control unit discharges the sheet according to the information stored in the storage unit.

5. The image forming apparatus according to claim 1, further comprising a potential measurement unit that measures charged potential of the upper loading surface when the printed sheet is discharged, wherein the control unit discharges the sheet according to a measurement result of the potential measurement unit.

6. The image forming apparatus according to claim 1, further comprising a sheet existence detection unit that detects existence of a sheet on a discharge tray, wherein the control unit takes into account the charge polarity to discharge the sheet if there is a sheet on the discharge tray according to the sheet existence detection unit and discharges the sheet without taking into account the charge polarity if there is no sheet on the discharge tray according to the sheet existence detection unit.

7. The image forming apparatus according to claim 1, wherein the control unit discharges the sheet so as to provide charge polarity that does not electrostatically attract a previous sheet printed previously and a following sheet printed next.

8. An image forming system comprising:

an image forming unit that prints an image on a sheet based on image data;

a conveyance unit comprising: a non-inversion conveyance unit that conveys the sheet to a downstream in a discharge direction without inverting the front and back through the image forming unit; and an inversion conveyance unit that inverts the front and back of the sheet with printing on one side and that conveys the sheet to an upstream in a sheet conveyance direction of the image forming unit;

a first sheet inversion unit that is arranged on the inversion conveyance unit and that inverts the front and back of the sheet conveyed by the inversion conveyance unit;

a control unit that controls the image forming unit and the conveyance unit, wherein the control unit includes a single-sided print mode that can print an image on the front of the sheet through conveyance by the non-inversion conveyance unit and a double-sided print mode that can print images on the front and back of the sheet through the conveyance by the non-inversion conveyance unit and inversion conveyance by the inversion conveyance unit, and at a breakpoint of jobs, the control unit discharges the sheet so as to provide charge polarity that does not electrostatically attract a sheet discharged just before the breakpoint and a sheet discharged just after the breakpoint at least in the double-sided print mode; and a charge unit that charges the printed sheet, wherein the control unit discharges the sheet just before the breakpoint and the sheet just after the breakpoint based on operation by the charge unit.

9. The image forming system according to claim 8, wherein in the discharge of the sheet just after the breakpoint, the control unit sets the same charge polarity for an upper loading surface of the sheet just before the breakpoint and for a lower loading surface of the sheet just after the breakpoint.

10. The image forming system according to claim 8, further comprising a second sheet inversion unit that is arranged on the conveyance unit from the image forming unit to the downstream in the discharge direction and that inverts the front and back of the sheet conveyed by the conveyance unit, wherein after printing of images on the front and back of the sheet by the image forming unit, the control unit can perform a non-inversion discharge operation for discharging the sheet without inverting the front and back of the sheet by the second sheet inversion unit and an inversion discharge operation for inverting the front and back of the sheet by the second sheet inversion unit to discharge the sheet, and the control unit selects one of the non-inversion discharge operation and the inversion discharge operation to discharge the sheet just after the breakpoint.

11. The image forming system according to claim 8, further comprising a storage unit that stores information related to the discharge direction of the front and back of the sheet just before the breakpoint, wherein the control unit discharges the sheet according to the information stored in the storage unit.

12. The image forming system according to claim 8, further comprising a potential measurement unit that measures charged potential of the upper loading surface when the printed sheet is discharged, wherein the control unit discharges the sheet according to a measurement result of the potential measurement unit.

13. The image forming system according to claim 8, further comprising a sheet existence detection unit that detects existence of a sheet on a discharge tray, wherein the control unit takes into account the charge polarity to discharge the sheet if there is a sheet on the discharge tray according to the sheet existence detection unit and discharges the sheet without taking into account the charge polarity if there is no sheet on the discharge tray according to the sheet existence detection unit.

14. The image forming system according to claim 8, wherein the control unit discharges the sheet so as to provide charge polarity that does not electrostatically attract a previous sheet printed previously and a following sheet printed next.

15. An image forming method of printing images on the front and back of a sheet based on image data, wherein the images are printed on the front and back of the sheet by non-inversion conveyance for conveying the sheet without inverting the front and back of the sheet and by inversion conveyance for conveying the sheet by inverting the front and back of the sheet, and then the sheet is discharged so as to provide charge polarity that does not electrostatically attract a sheet discharged just before a breakpoint of jobs and a sheet discharged just after the breakpoint, the printed sheet is charged by a charge unit, and the control unit discharges the sheet just before the breakpoint and the sheet just after the breakpoint based on operation by the charge unit.

* * * * *